United States Patent [19]

Perry

[11] Patent Number: 4,730,745

[45] Date of Patent: Mar. 15, 1988

[54] TAMPER INDICATING PLUG STYLE CLOSURE

[75] Inventor: Robert A. Perry, Toledo, Ohio

[73] Assignee: Owens-Illinois Closure Inc., Toledo, Ohio

[21] Appl. No.: 31,968

[22] Filed: Mar. 30, 1987

[51] Int. Cl.[4] ..... B65D 41/46; B65D 41/58

[52] U.S. Cl. ..... 215/230; 215/254; 215/274

[58] Field of Search ..... 215/274, 254, 253, 230

[56] References Cited

U.S. PATENT DOCUMENTS

| | | | |
|---|---|---|---|
| 2,108,583 | 2/1938 | Falk | 215/274 |
| 3,924,771 | 12/1975 | Cleff | 215/253 X |
| 3,952,901 | 4/1976 | Conti | 215/254 X |
| 3,966,082 | 6/1976 | Hopkins | 215/274 X |
| 4,271,972 | 6/1981 | Thor | 215/253 X |
| 4,519,516 | 5/1985 | Amos | 215/274 X |

FOREIGN PATENT DOCUMENTS

| | | | |
|---|---|---|---|
| 352642 | 7/1931 | United Kingdom | 215/274 |

*Primary Examiner*—Donald F. Norton

[57] ABSTRACT

A package that is made of a blown plastic container and a two-piece or composite closure which is secured to a neck portion of the container. The closure includes a molded plastic plug style closure with an inner annular member which engages the inside of the neck of the container, an outer annular member which closely surrounds the outside of the neck of the container and a top panel from which the inner and outer annular members depend and which spans the rim of the container. The second piece of the closure is a molded plastic collar which surrounds the outer annular member of the plug style closure and which is frictionally interlocked therewith. The bottom of the collar has an inwardly and upwardly extending flange which engages a bead on the outside of the neck of the container to interlock the collar and the container. Further, the collar has one or more vertical tear strips to permit the tearing of the collar to thereby permit its removal from the container, and thereby to permit the removal of the plug style closure from the container, and this tearing of the collar imparts tamper indicating characteristics to the closure and to the package which includes such closure. The container has a radial shoulder positioned below the bottom of the collar to prevent the collar from being moved axially downwardly on the container.

19 Claims, 4 Drawing Figures

TAMPER INDICATING PLUG STYLE CLOSURE

BACKGROUND OF THE INVENTION

1. Field of the Invention

This invention relates to a two-piece closure for a blown plastic or glass container, the closure including a molded plastic inner plug style closure and a molded plastic collar which must be removed from the container before the molded plastic inner plug style closure can be removed, and which must be visibly and irreparably damaged during such removal to provide evidence of a prior opening or attempted opening of the container as as indication of any tampering with the container or its contents.

2. Description of the Prior Art

Molded plastic plug style closures are widely used as closures for bottles for the packaging of various dry, comestible products, for example, vitamin tablets, and are especially popular for packaging applications of this type which utilize blown plastic bottles as the container elements thereof, because of the similarity in the manufacturing tolerances which apply to the molded plastic plug style closures, on the one hand, and to the corresponding blown plastic bottles, on the other hand. However, such molded plastic plug style closures, each of which sealingly engages the bottle in which it is placed on the inside surface of the bottle neck, are not inherently tamper indicating upon the first removal of the closure from the bottle, and wherever it is desired to provide a bottle which is closed with a molded plastic plug style closure with tamper indicating opening characteristics, it is necessary to provide a separate element such as a tape or an overcap which must be torn away or otherwise irreparably damaged before the plug style closure can be removed from the bottle. For example, U.S. Pat. No. 3,924,771 (G. Cleff) discloses a heat shrinkable plastic foil outer cap which is placed over the neck portion of a bottle that is capped by a separate plug style or other closure. U.S. Pat. No. 4,271,972 (D. L. Thor) discloses a molded plastic overcap for a container which is closed by a plug closure, but the overcap of this reference is hinged, and, consequently, requires a complex latch type locking means to ensure that the integrity of the overcap is destroyed upon its first removal, as is required for proper tamper indicating performance characteristics. U.S. Pat. No. 3,952,901 (V. N. Conti) discloses a molded plastic closure retaining collar with a vertically extending tear strip to impart tamper indicating characteristics to such closure, but the closure of the container of this reference is an helically threaded closure, and it would appear that such a closure could be unscrewed from the associated container by a firm gripping and turning force applied to the exterior of the molded plastic overcap, a type of motion which would not result in the removal of a plug style closure from the container. U.S. Pat. No. 3,966,082 (B. D. Hopkins) discloses a package which is made up of a can, a plug style closure for an end of the can, and a molded plastic collar or overcap that secures the closure to the body of the can. However, the overcap of the package of this reference can be removed without irreparably damaging it, and, consequently, the package of this reference does not have tamper indicating opening characteristics.

SUMMARY OF THE INVENTION

According to the present invention, there is provided a two-piece or composite tamper indicating closure for a blown plastic container, the closure being made up of a molded plug style cap with an inner peripheral flange that sealing engages the inside of the finish of the bottle, and a molded plastic collar which secures the plug style cap to the finish of the bottle and which has a vertical tear strip to permit the removal of the collar before the initial opening of the container. The assembly that includes the plug style cap, the collar, and the container is interlocked by means of an interference fit between an inwardly projecting bead at the top of the collar and the outside of the diameter of the plug style cap, and by an interference fit between inwardly and upwardly directed flange at the bottom of the collar and an outwardly projecting bead on the finish of the container. The container, further, includes a radial shoulder that underlies the bottom of the collar to prevent the collar from being moved axially downwardly on the container.

Accordingly, it is an object of the present invention to provide an improved, tamper indicating plug style closure for a container, and it is a corresponding object of the present invention to provide a package which includes a container and an improved, tamper indicating plug style closure in closing relationship with such container.

It is a further object of the present invention to provide an improved, two-piece or composite plug style closure for a container, and it is an corresponding object of the present invention to provide a package which includes a container and an improved two-piece composite plug style closure in closing relationship with such container.

For a further understanding of the present invention and the objects thereof, attention is directed to the drawings and the following brief description thereof, to the detailed description of the preferred embodiment and to the appended claims.

DETAILED DESCRIPTION OF THE PREFERRED EMBODIMENT

Figure 1:
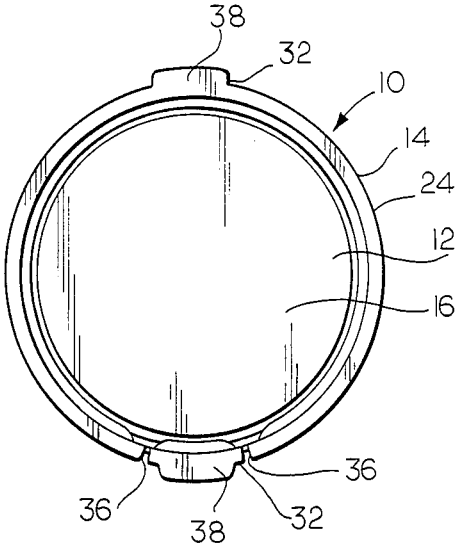
FIG. 1 is a top plan view of a package according to the present invention.
Figure 2:
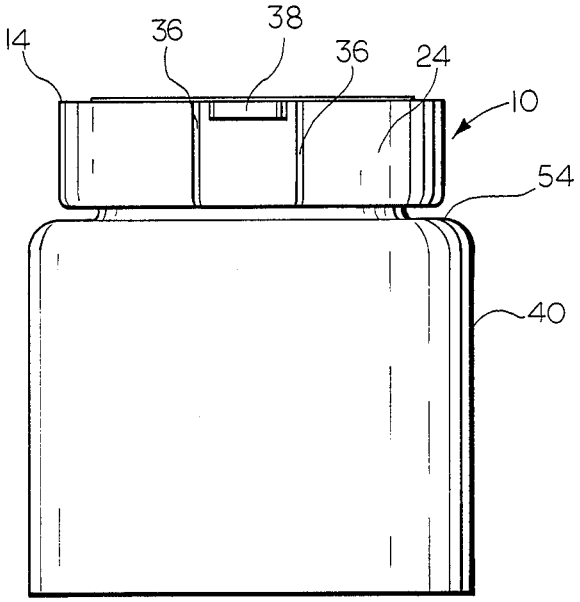
FIG. 2 is a elevational view of the package illustrated in FIG. 1.
Figure 3:
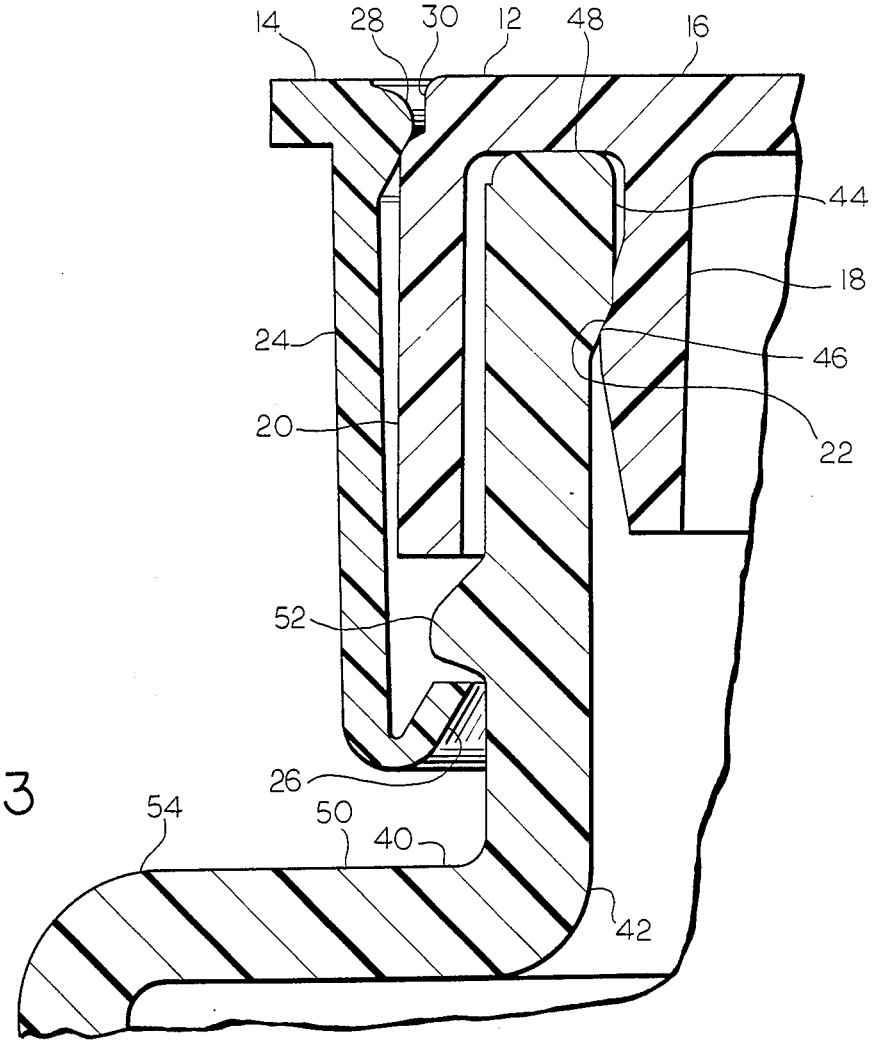
FIG. 3 is a fragmentary elevational view, partly in section and at an enlarged scale, of the package illustrated in FIGS. 1 and 2.
Figure 4:
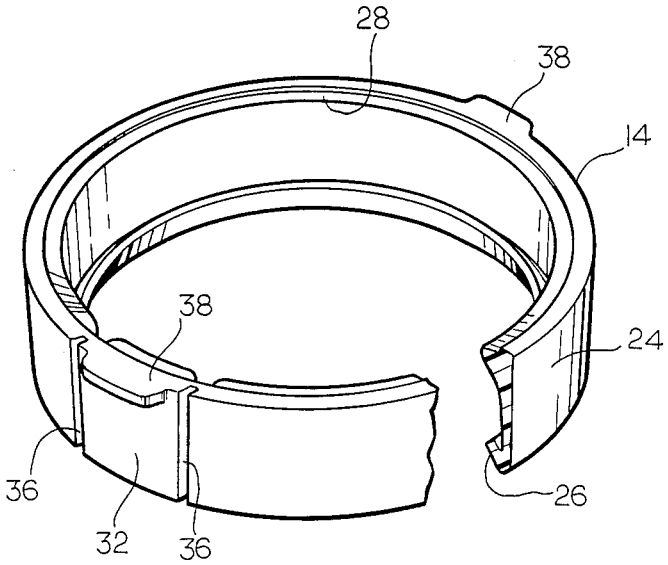
FIG. 4 is a perspective view, partly broken away, of an element of the package which is illustrated in FIGS. 1 through 3.

A closure according to the present invention is indicated generally by reference numeral 10 in the drawing. The closure 10, as is shown in FIG. 2, is adapted to be applied in closing relationship to a container, indicated generally by reference numeral 40, which is of a type that may be considered to be suitable for the packaging of various dry products, for example, vitamin tablets, a type of container which is frequently manufactured from a thermoplastic material by a blow molding process. Typically, the container 40 is manufactured with a nominal outside diameter (the "T" dimension, in the terminology of the Glass Packaging Institute) of 24–28 millimeters. In any case, the container 40 is provided with an inside wall 42 which has a reduced diameter portion 44 to define an annular shoulder 46 which is disposed near, but slightly below, an uppermost rim portion 48 of the container 40. Further, the container 40 has an outside surface 50, with an outwardly radially projecting bead 52 being formed in the outside surface 50 at an elevation somewhat below that of the annular shoulder 46 in the inside surface 42.

The closure 10 is made up of an inner plug style closure 12 and an outer tamper indicating collar which must be removed from the inner plug style 12 before the inner plug style 12 can be removed from the container 40. The inner plug style closure 12 is molded in a single piece from a suitable thermoplastic material, for example, high density polyethylene or polypropylene, in which case it may be molded in the illustrated configuration by injection molding, and includes a top panel portion 16 which spans the rim 48 of the container 40, an inner annular portion 18 which extends downwardly from a juncture with the top panel portion 16 and which is adapted to be positioned within the inside surface 42 of the container 40, and an outer annular portion 20 which extends downwardly from a juncture with the top panel portion 16 and which is adapted to surround an upper portion of the outside surface 50 of the container 40. A secure friction or snap fit between the inner plug style closure 12 and the container 40 is achieved by providing the inner annular portion 18 of the inner plug style closure 12 with an annular shoulder 22 which engages the annular shoulder 46 of the container 40 in an interference fit, to thereby require the application of a significant level of manual force to the inner plug style closure 12 in order to be able to disengage it from the container 40.

The outer tamper indicating collar 14 includes an annular skirt member 24 which surrounds the outer annular portion 20 of the inner plug style closure 12 and which extends downwardly below the level of the annular bead 52 of the container. The outer tamper-indicating collar 14 is interlocked with the container 40 by providing the outer tamper indicating collar 14 with a flexible, annular tamper indicating flange 26 which extends inwardly and upwardly from the lowermost margin of the annular skirt member 24 to engage the underside of the annular bead 52 in an interference fit. Further, the outer tamper indicating collar 14 is interlocked with the inner plug style closure 12 by providing one of such members, shown as the outer tamper indicating collar 14, with a bead 28 projecting therefrom toward the other of such members and by providing the other of such members, shown as the inner plug style closure 12, with an annular recess 30 which receives the annular bead 28 to form an interference fit between such inner plug style closure 12 and such outer tamper indicating collar 14.

Because of the interference fit between the outer tamper indicating collar 14 and the container 40, on the one hand, and the interference fit between the annular bead 28 of the outer tamper indicating collar 14 and the annular recess 30 of the inner plug style closure 12, on the other hand, it is necessary to visibly and irreparably damage the outer tamper indicating collar 14 before the inner plug style closure 12 can be removed from the container 40. Such visible and irreparable damage to the outer tamper indicating collar 14, in the illustrated embodiment of the invention, is accomplished by providing the outer tamper indicating collar 14 with one or more vertical tear strips 32, shown as being a pair of such vertical tear strips 32 at diametrically opposed locations of the outer tamper indicating collar 14. Each vertical tear strip 32 is formed within the annular skirt member 24 of the outer tamper indicating collar 14 and is separated therefrom by spaced apart tear lines 36 which may be formed in the annular skirt member 24 by scoring or by the molding process employed to mold the outer tamper indicating collar 14. In any case, each vertical tear strip 32 is, preferably, provided with an outwardly projecting tab 38 at the top thereof to facilitate grasping by a user upon the first opening of the package that includes the container 40 and the closure 10. To further ensure the need to visibly and irreparably damage the outer tamper indicating collar 14 before the inner plug style closure 12 can be removed from the container 40, the container 40, preferably, is also provided with a radially extending annular shoulder 54 slightly below the bottom of the annular skirt member 24 of the outer tamper indicating collar 14 to prevent the outer tamper indicating collar 14 from being moved axially downwardly on the container 40.

The outer tamper indicating collar 14 is also, preferably, formed in a single piece from a suitable plastic material, such as high density polyethylene or polypropylene, and it may be satisfactorily formed from such a material by an injection molding process. Preferably, to accentuate the tamper indicating characteristics of the closure 10, the outer tamper indicating collar 14 is formed in a different color than the inner plug style closure 12, to provide a very noticeable change in the appearance characteristics of a package that includes the container 40 and the closure 10, after the removal of the outer tamper indicating collar 14 element of the closure 10.

In the use of injection molding processes to form both the inner plug style closure 12 and the outer tamper indicating collar 14 of the closure 10, both the inner style closure 12 and the outer tamper indicating collar 14 are provided with dimensional tolerance characteristics which are quite compatible with the dimensional characteristics of the container 40, when such container 40 is produced from a thermoplastic material by a blow molding process. Further, the design of each of the inner plug style closure 12 and the outer tamper indicating collar 14 of the closure 10, as shown and described, is such that such elements can be produced in simple multi-cavity plastic injection molds, which is a type of manufacturing equipment that is in widespread use in the plastic molding industry and one that requires infrequent and relatively inexpensive maintenance.

Although the best mode contemplated by the inventor for carrying out the present invention as of the filing hereof has been shown and described herein, it will be apparent to thoses skilled in the art that suitable modification, variations and equilvalents may be made without departing from the scope of the invention, such scope being limited solely by the terms of the following claims.

What is claimed is:

1. A composite, tamper indicating closure for a container having an annular neck, the annular neck having an inner surface and an outer surface terminating in a rim, the outer surface of the annular neck having an outwardly projecting portion, said closure comprising, in combination:

an inner member, said inner member comprising, a top panel portion, said top panel portion being adapted to span the rim of the container;

an inner annular portion, said inner annular portion extending downwardly from a juncture with said top panel portion and having an outer surface, said inner annular portion being adapted to be positioned within the annular neck of the container with said outer surface of said inner annular portion in engagement with the inner surface of the annular neck of the container, and an outer annular portion, said outer annular portion extending downwardly from said top panel portion and having an inner surface, said inner surface of said outer annular portion being adapted to be positioned adjacent to the outer surface of the annular neck of the container when said inner annular portion of said inner member is positioned within the annular neck of the container;

an annular outer member, said outer member comprising;

a skirt;

container engaging means, said container engaging means extending inwardly and upwardly from said skirt and being adapted to engage the outwardly projecting portion of the outer surface of the annular neck of the container to prevent the removal of said annular outer member from the container over the rim of the container without visible alternation of the condition of said annular outer member; and locking means for locking said annular outer member to said inner member to prevent the removal of said inner member from the container without said visible alteration of the condition of said annular outer member.

2. A composite, tamper indicating closure according to claim 1 wherein said annular outer member further comprises:

manually graspable tear tab means for tearing said skirt of said annular outer member to visibly alter said condition of said annular outer member, and to thereby permit said outer member to be removed from the container and to permit said removal of said inner member from the container.

3. A composite, tamper indicating closure according to claim 1 wherein said locking means comprises recess means and projection means received in said recess means, said recess means being located in one of said inner member and said annular outer member, said projection means being located in the other of said inner member and said annular outer member.

4. A composite, tamper indicating closure according to claim 3 wherein said projection means is located in said annular outer member and comprises bead means projecting radially inwardly from said skirt of said annular outer member, and wherein said recess means is located in said inner member and comprises a recess at said juncture of said inner annular portion and said top panel portion.

5. A composite, tamper indicating closure according to claim 1 wherein said inner member is molded in a single piece from a thermoplastic material.

6. A composite, tamper indicating closure according to claim 5 wherein said annular outer member is molded in a single piece from a second thermoplastic material.

7. A composite, tamper indicating closure according to claim 6 wherein said thermoplastic material has a first color, wherein said second thermoplastic material has a second color and wherein said second color is different than said first color.

8. A package comprising, in combination:

a container having an annular neck, said annular neck having an inner surface and an outer surface and terminating in a rim, said outer surface of said annular neck having an outwardly projecting portion; and a composite, tamper indicating closure affixed to said neck of said container, said composite, tamper indicating closure comprising;

an inner member, said inner member comprising, a top panel portion, said top panel portion spanning said rim of said container;

an inner annular portion, said inner annular portion extending downwardly from a juncture with said top panel portion and having an outer surface, said inner annular portion being positioned within said annular neck of said container with said outer surface of said inner annular portion in engagement with said inner surface of said annular neck of said container, and an outer annular portion, said outer annular portion extending downwardly from said top panel portion and having an inner surface, said inner surface of said outer annular portion being positioned adjacent to said outer surface of said annular neck of said container when said inner annular portion of said inner member;

an annular outer member, said outer member comprising;

a skirt;

container engaging means, said container engaging means extending inwardly and upwardly from said skirt and engaging said outwardly projecting portion of said outer surface of said annular neck of said container to prevent the removal of said annular outer member from said container over said rim of the container without visible alternation of the condition of said annular outer member; and locking means for locking said annular outer member to said inner member to prevent the removal of said inner member from said container without said visible alteration of the condition of said annular outer member.

9. A package according to claim 8 wherein said annular outer member of said closure further comprises:

manually graspable tear tab means for tearing said skirt of said annular outer member to visibly alter said condition of said annular outer member, and to thereby permit said outer member to be removed from said container and to permit said removal of said inner member from the container.

10. A package according to claim 9 wherein said container further has outwardly projecting annular shoulder means positioned below said outwardly projecting portion of said container and below said annular outer member of said closure, said outwardly projecting annular shoulder means preventing said annular outer member of said closure from being moved axially downwardly on said container for a substantial distance to thereby prevent the removal of said inner member of said closure from said container without tearing said skirt of said annular outer member.

11. A package according to claim 8 wherein said locking means of said closure comprises recess means and projection means received in said recess means, said recess means being located in one of said inner member and said annular outer member of said closure, said projection means being located in the other of said inner member and said annular outer member of said closure.

12. A package according to claim 11 wherein said projection means is located in said annular outer member and comprises bead means projecting radially inwardly from said skirt of said annular outer member, and wherein said recess means is located in said inner member and comprises a recess at said juncture of said inner annular portion and said top panel portion.

13. A package according to claim 8 wherein said inner member of said closure is molded in a single piece from a thermoplastic material.

14. A package according to claim 13 wherein said annular outer member of said closure is molded in a single piece from a second thermoplastic material.

15. A package according to claim 14 wherein said thermoplastic material has a first color, wherein said second thermoplastic material has a second color and wherein said second color is different than said first color.

16. A package according to claim 14 wherein said container is produced from a thermoplastic material.

17. A package according to claim 16 wherein said container is produced by a blow molding process.

18. A package according to claim 16 wherein said inner surface of said annular neck of said container comprises a first annular shoulder and wherein said outer surface of said inner portion of said closure comprises a second annular shoulder, said first annular shoulder forming an interference fit with said second annular shoulder to help prevent inadvertent disengagement of said inner member of said closure from said container after the removal of said annular outer member of said closure from said package.

19. A package according to claim 8 wherein said inner surface of said annular neck of said container comprises a first annular shoulder and wherein said outer surface of said inner portion of said closure comprises a second annular shoulder, said first annular shoulder forming an interference fit with said second annular shoulder to help prevent inadvertent disengagement of said inner member of said closure from said container after the removal of said annular outer member of said closure from said package.

* * * * *